United States Patent [19]

Nubani et al.

[11] 4,213,663

[45] Jul. 22, 1980

[54] WET CARBON-DIOXIDE TREATMENT OF PARTIALLY-COMPLETED CRT

[75] Inventors: Jawdat I. Nubani, Clarks Summit; Frank S. Sawicki, Scranton, both of Pa.

[73] Assignee: RCA Corporation, New York, N.Y.

[21] Appl. No.: 973,454

[22] Filed: Dec. 26, 1978

[51] Int. Cl.[2] ..... H01J 9/395

[52] U.S. Cl. ..... 316/24; 316/19; 316/21

[58] Field of Search ..... 316/19, 21, 24

[56] References Cited

U.S. PATENT DOCUMENTS

| | | | |
|---|---|---|---|
| 3,063,777 | 11/1962 | Trax | 316/2 |
| 3,410,723 | 11/1968 | Cohz | 316/24 |
| 3,589,791 | 6/1971 | Kanellopoulos | 316/24 |
| 3,658,401 | 4/1972 | Files | 316/21 |
| 3,932,011 | 1/1976 | Piascinski | 316/21 |
| 4,048,545 | 9/1977 | Madden | 316/2 |

*Primary Examiner*—John McQuade

*Attorney, Agent, or Firm*—E. M. Whitacre; G. H. Bruestle; L. Greenspan

[57] ABSTRACT

In a method of making a virgin CRT (cathode-ray tube), soon after the panel and funnel are sealed together to form a bulb, the inside of the bulb is flushed with wet carbon-dioxide gas and then flushed with dry noncontaminating gas. Subsequently, the mount assembly is sealed into the funnel, and then the bulb is exhausted, sealed and gettered to produce the finished CRT.

8 Claims, 1 Drawing Figure

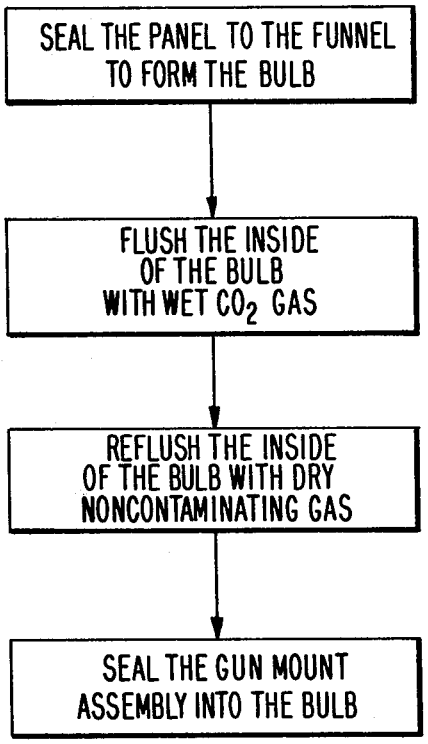
SEAL THE PANEL TO THE FUNNEL TO FORM THE BULB
FLUSH THE INSIDE OF THE BULB WITH WET $CO_2$ GAS
REFLUSH THE INSIDE OF THE BULB WITH DRY NONCONTAMINATING GAS
SEAL THE GUN MOUNT ASSEMBLY INTO THE BULB

WET CARBON-DIOXIDE TREATMENT OF PARTIALLY-COMPLETED CRT

BACKGROUND OF THE INVENTION

This invention relates to a method for making a CRT (cathode-ray tube) and particularly to a novel method of treating a partially-completed virgin CRT prior to sealing the mount assembly into the bulb.

As used herein, a virgin CRT is one which has never been exhausted, sealed, and gettered, and hence has no residual getter material present therein.

A shadow-mask color-television picture tube is a CRT which is usually prepared by steps including (a) producing a luminescent viewing screen structure upon the inner surface of a faceplate panel, (b) sealing the panel to the large opening of a funnel, (c) sealing a mount assembly into the small opening or neck of the funnel, and then (d) baking, exhausting, gettering and sealing the tube.

The electron emissions from the cathodes in the mount assemblies of some tubes were found to decrease rapidly with the amount of time the tubes were operated. It is known that the emissions from the cathodes in gassy tubes decrease in this way. Such decreases are attributed to destructive bombardment of the cathode by ions in the tube and/or by the deposition on the cathode of carbon from the decomposition of hydrocarbon gases in the tube.

In the art of making new or virgin cathode-ray tubes, various bulb treatments that are applied before sealing the mount assembly into the bulb have been suggested for various purposes. U.S. Pat. No. 3,589,791 to J. A. Kanellopoulos discloses injecting water into the bulb between the panel-sealing and mount-sealing steps in order to increase the humidity in the bulb, which increases the latitude of the subsequent CRT fabrication processes. U.S. Pat. No. 3,658,401 to J. A. Files discloses flushing the bulb after panel sealing with dry noncontaminating gas in order to reduce the rate of depletion of the getter during the operation of the finished CRT. U.S. Pat. No. 3,932,011 to J. J. Piascinski discloses flushing the bulb while still hot from panel sealing with a dry noncontaminating gas, reflushing the bulb after it has cooled with a dry noncontaminating gas and then temporarily capping the bulb to prevent degradation of the viewing screen when the bulb must wait a long time in potentially high humidities before it is exhausted and sealed.

In the art of rebuilding used cathode-ray tubes, the mount assembly is removed and replaced with a new mount assembly. This process is also called regunning. U.S. Pat. No. 3,063,777 to A. M. Trax discloses the step, when removing the mount assembly from the used CRT, of filling the bulb with a dry noncontaminating gas and then regunning the bulb in this atmosphere in order to avoid the baking normally done during the exhausting operation. U.S. Pat. No. 4,048,545 to T. H. Madden et al discloses, after removing the mount assembly from the used CRT, flushing the bulb with wet carbon-dioxide gas until the residual barium metal getter material is converted to barium carbonate, and not to other barium compounds which, by a complex series of chemical reactions, cause decreases in electron emissions from the cathodes of the rebuilt tube due to ion bombardment and/or deposition of carbon from the decomposition of hydrocarbon gases in the tube.

SUMMARY OF THE INVENTION

The novel method is applied to a virgin CRT bulb and is conducted for completely different purposes than the methods mentioned above in the prior art.

The novel method comprises the steps, soon after sealing the panel and funnel together and prior to sealing the mount assembly into the bulb, of flushing the inside of the bulb with wet carbon dioxide gas and then flushing it with dry noncontaminating gas. It is believed that the wet carbon dioxide flush chemically stabilizes any reactive materials in the bulb. It assures that there will not be ion burn and/or carbon deposition on the cathode surfaces in the finished CRT, which would rapidly decrease the electron emissions from the cathodes during the operational life of the tube. The subsequent dry-gas flush provides a protective cover over the viewing screen in the bulb. Experience has shown that the cathodes of tubes made with bulbs treated by the novel method do not fail for ion bombardment and/or carbon deposition on the cathodes.

BRIEF DESCRIPTION OF THE DRAWING

The sole FIGURE is a flow diagram of the novel method.

DESCRIPTION OF THE PREFERRED EMBODIMENTS

The steps of the novel method are generally those that are used for making a shadow-mask CRT. In that method, a glass faceplate panel is heat sealed to a glass funnel with a devitrifiable glass frit by the method described, for example, in U.S. Pat. No. Re. 25,791 to S. A. Claypoole to form the bulb. Prior to heat sealing the panel to the funnel, a mask assembly is mounted in the faceplate panel, and a viewing-screen structure is produced on the inner surface of the panel. Also, the funnel is provided with an internal conducting coating, which may be comprised of graphite. The funnel is comprised of a cone adapted to be sealed at its larger end to the faceplate panel and a cylindrical neck at its smaller end adapted to receive the stem of a mount assembly.

In accordance with the novel method, as shown in the sole FIGURE, shortly after the bulb leaves the panel-sealing lehr, and while it is still hot (about 200° C.) from the lehr, the inside of the bulb is flushed with wet $CO_2$ (carbon dioxide) gas. Wet $CO_2$ gas may be produced by bubbling $CO_2$ gas from a cylinder of compressed $CO_2$ gas through deionized water. When prepared by this method, the gas has a dew point of about room temperature (22° C.). However, the dew point of the $CO_2$ gas may be as low as about 0° C. and as high as 100° C. provided moisture does not condense in the bulb during or after flushing with the $CO_2$ gas. Also, while it is preferred that the temperature of the bulb is higher than about 50° C. (in order to avoid condensation of moisture) when it is flushed with wet $CO_2$, the bulb may be warm, cool or cold. The rate of flushing may be in the range from about 0.5 CFM (cubic feet per minute) to about 5 CFM, and the time period of flushing may be in the range from about 0.5 minute to about 5 minutes. Generally, the smaller the tube, the lower the flushing rate and/or the shorter the flushing time.

Flushing may be done by the method shown, for example, in FIGS. 2 to 4 of U.S. Pat. No. 3,658,401 to J. A. Files, by inserting an elongated tube and a surrounding resilient stopper into the open end of the neck of the bulb and admitting the gas from a gas source through a valve and associated tubing. The upper end of the elongated tube may be formed with apertures for directing the gas in a desired manner; for example, outwardly. The outer periphery of the stopper is either noncircular or is formed with longitudinal grooves or holes to permit the residual gases within the bulb to be driven out by the gas that is introduced. Instead of centering the elongated tube axially with respect to the stopper, the elongated tube may be eccentric to the stopper to improve the flushing action. The sizes of the elongated tube and the tubing, the sizes of the apertures and the grooves, and the gas pressure used to introduce the gas are chosen to provide the desired flushing action within the desired flushing time. In one apparatus that has been used successfully in making twenty-one-inch rectangular color picture tubes, the bulb is flushed at the rate of about 2 cubic feet per minute for about 2 minutes, and the volume within the bulb is exchanged at least six times.

After the flushing with wet $CO_2$ gas is completed, the flushing apparatus is removed. The inside of the bulb is now flushed in the same manner as described above with a dry noncontaminating gas, preferably warm air having a dew point of about −22° F. The dry noncontaminating gas used for flushing is preferably dry warn air containing about 350 ppm water vapor (which has a dew point of about −22° F. or −30° C.). The flushing gas should be nonreactive to the tube structure. Air, oxygen, nitrogen, argon, helium, neon, and mixtures thereof may be used. The water-vapor content of the gas should be less than 1,000 ppm or have a dew point of less than about −4° F., Hydrocarbon gases, carbon dioxide, and other contaminants, if any, should be removed from the flushing gas. The temperature of the flushing gas is not critical and may be at, above, or below room temperature. After flushing with dry gas, a resilient cap, such as that shown in FIG. 5 of the above-cited Files patent, may be applied to cover the neck opening to maintain the bulb assembly filled with the dry noncontaminating gas at atmospheric pressure for a relatively long term prior to the next manufacturing operation, which is usually the mount-sealing step. It has been found that envelopes so flushed and capped can be held or stored for several weeks, if necessary or desired, without substantial degradation of the screen structure.

The bulb may pass to the next operation without capping, or, if it has been capped, the cap is removed. Then, the mount assembly is inserted in the neck of the bulb and the glass stem of the mount assembly sealed into the neck by known methods; for example, as described in U.S. Pat. No. 3,807,006 to J. F. Segro et al. The bulb with the mount assembly sealed therein may now be exhausted and baked to remove gases therein and to degas various of the structures and internal surfaces, by any known method; for example, as described in U.S. Pat. No. 2,532,315 to A. L. Johnson et al. After exhausting and baking the bulb assembly, the tube is completed by performing the conventional steps of activating the cathode, tipping off the exhaust tubulation, flashing the getter, aging the cathodes, and testing the tube.

We claim:

1. In the method of making a cathode-ray tube including the steps of (i) producing a luminescent viewing-screen structure upon the inner surface of a faceplate panel, (ii) heat sealing said panel to the large opening of a funnel to form a virgin bulb, (iii) flushing said virgin bulb with a dry noncontaminating gas, (iv) and then heat sealing a mount assembly to the small opening of said funnel, the step subsequent to step (ii) and prior to step (iii) of flushing the inside of said virgin bulb with wet carbon-dioxide gas.

2. The method defined in claim 1 wherein said wet carbon dioxide gas has a dew point in the range of 0° to 100° C.

3. The method defined in claim 1 wherein said wet carbon dioxide gas is introduced into said bulb at the rate of about 0.5 to 5.0 cubic feet per minute.

4. The method defined in claim 1 wherein said bulb is flushed with wet carbon dioxide gas for about 0.5 to 5.0 minutes.

5. The method defined in claim 1 wherein said bulb is flushed with wet carbon dioxide while said bulb is still hot from heat sealing said panel to said funnel.

6. The method defined in claim 5 wherein the temperature of said bulb is higher than about 50° C.

7. The method defined in claim 1 wherein said carbon dioxide gas has a dew point of about room temperature.

8. The method defined in claim 7 wherein said bulb is flushed with wet carbon dioxide gas at the rate of about 2 cubic feet per minute for about 2 minutes.

* * * * *